US011590775B2

(12) United States Patent
Katagami

(10) Patent No.: US 11,590,775 B2
(45) Date of Patent: Feb. 28, 2023

(54) RECORDING DEVICE AND METHOD FOR DRYING RECORDING MEDIUM

(71) Applicant: SEIKO EPSON CORPORATION, Tokyo (JP)

(72) Inventor: Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/445,104

(22) Filed: Aug. 16, 2021

(65) Prior Publication Data

US 2022/0055380 A1 Feb. 24, 2022

(30) Foreign Application Priority Data

Aug. 19, 2020 (JP) ..... JP2020-138621

(51) Int. Cl.
*B41J 11/02* (2006.01)
*B41J 11/00* (2006.01)

(52) U.S. Cl.
CPC ..... *B41J 11/0022* (2021.01); *B41J 11/02* (2013.01)

(58) Field of Classification Search
CPC ... B41J 11/002; B41J 11/0005; B41J 11/0015; B41J 11/0022; B41J 11/00222; B41J 11/00224; B41J 11/02
See application file for complete search history.

(56) References Cited

U.S. PATENT DOCUMENTS

2011/0050824 A1 3/2011 Toya et al.
2012/0281037 A1* 11/2012 Toya ..... B41J 15/04 347/16
2018/0272754 A1* 9/2018 Matsuoka ..... B41J 11/0024

FOREIGN PATENT DOCUMENTS

JP 2011-046096 A 3/2011

* cited by examiner

*Primary Examiner* — Scott A Richmond
(74) *Attorney, Agent, or Firm* — Workman Nydegger

(57) ABSTRACT

A recording device includes a transport unit configured to alternately repeat transport and stop of a recording medium, a recording head configured to discharge ink onto the recording medium to form an image while the recording medium is stopped in an image forming region, a drying unit including a plate in which a plurality of openings for blowing an air flow are formed in a position facing the recording medium transported by the transport unit, and being configured to dry the recording medium on which an image is formed by the recording head, and a relative movement unit configured to move the recording medium and the plate relatively in an intersecting direction that intersects a facing direction in which the recording medium and the plate face each other, while the recording medium is stopped in the image forming region.

9 Claims, 6 Drawing Sheets

RECORDING DEVICE AND METHOD FOR DRYING RECORDING MEDIUM

The present application is based on, and claims priority from JP Application Serial Number 2020-138621, filed Aug. 19, 2020, the disclosure of which is hereby incorporated by reference herein in its entirety.

BACKGROUND

1. Technical Field

The present disclosure relates to a recording device and a method for drying a recording medium.

2. Related Art

A recording device that discharges ink onto a recording medium to form an image has been used. Among such recording devices, there is a recording device including a drying unit that dries ink discharged onto a recording medium. For example, JP-A-2011-46096 discloses a recording device that discharges ink onto a recording medium to form an image, and that includes a drying device that dries ink discharged onto a recording medium.

Here, JP-A-2011-46096 discloses the recording device including the drying device that dries a recording medium by blowing heated air onto the recording medium on which ink is discharged via a slit hole provided in a slit plate. In this way, a drying unit for blowing an air flow from an opening and dries a recording medium can dry a wide range of the recording medium, also has a simple configuration, and is more likely to be adopted in a recording device. However, in a recording device configured to alternately repeat transport and stop of a recording medium and also form an image while the recording medium is stopped, drying irregularities may occur when drying time is reduced. A recording medium stops during formation of an image, and thus when the drying unit having such a configuration is adopted, an air flow is directly blown onto a portion of the recording medium facing the opening and drying is effectively advanced. On the other hand, an air flow is reduced at a portion of the recording medium away from the portion facing the opening, and thus drying takes time. Therefore, in a known recording device as described in JP-A-2011-46096, drying time of an entire recording medium may be long. On the other hand, a configuration in which an air flow at a high temperature can be blown or a configuration in which a strong air flow can be blown requires excessive energy, and causes the device to increase in complexity, size, and the like.

SUMMARY

Thus, a recording device according to the present disclosure for solving the above-described problem includes a transport unit configured to alternately repeat transport and stop of a recording medium, a recording head configured to discharge ink onto the recording medium to form an image while the recording medium is stopped in an image forming region, a drying unit including a plate in which a plurality of openings for blowing an air flow are formed in a position facing the recording medium transported by the transport unit, and being configured to dry the recording medium on which an image is formed by the recording head, and a relative movement unit configured to move the recording medium and the plate relatively in an intersecting direction that intersects a facing direction in which the recording medium and the plate face each other, while the recording medium is stopped in the image forming region.

Further, a method for drying a recording medium according to the present disclosure for solving the above-described problem is a method for drying a recording medium in a recording device including a transport unit configured to alternately repeat transport and stop of a recording medium, a recording head configured to discharge ink onto the recording medium to form an image while the recording medium is stopped in an image forming region, and a drying unit including a plate in which a plurality of openings for blowing an air flow are formed in a position facing the recording medium transported by the transport unit, and being configured to dry the recording medium on which an image is formed by the recording head, and the method includes moving the recording medium and the plate relatively in an intersecting direction that intersects a facing direction in which the recording medium and the plate face each other, while the recording medium is stopped in the image forming region.

DESCRIPTION OF EXEMPLARY EMBODIMENTS

Figure 1:
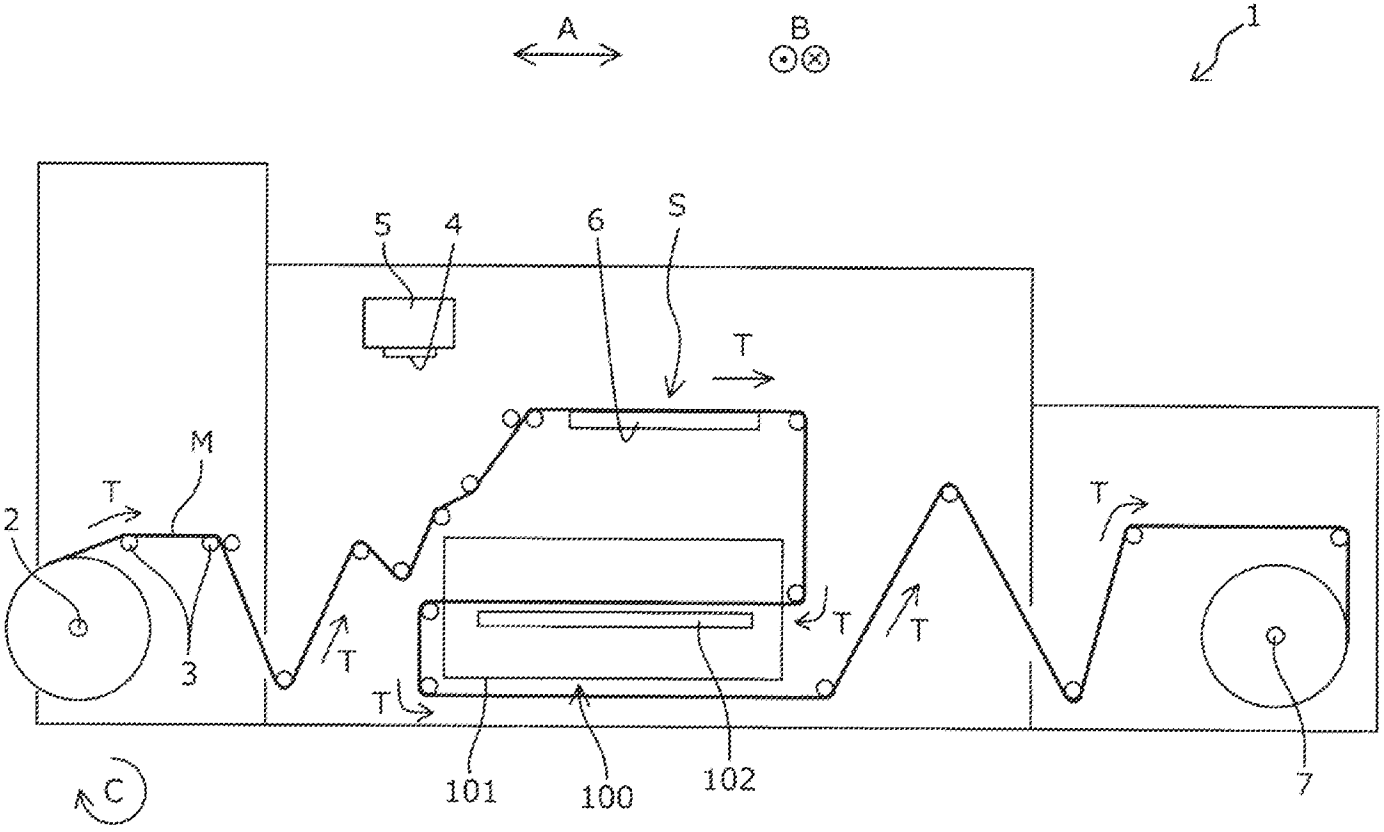
FIG. 1 is a schematic side view of a recording device according to Example 1 of the present disclosure.

First, the present disclosure will be schematically described.

A recording device according to a first aspect of the present disclosure for solving the above-described problem includes a transport unit configured to alternately repeat transport and stop of a recording medium, a recording head configured to discharge ink onto the recording medium to form an image while the recording medium is stopped in an image forming region, a drying unit including a plate in which a plurality of openings for blowing an air flow are formed in a position facing the recording medium transported by the transport unit, and being configured to dry the recording medium on which an image is formed by the recording head, and a relative movement unit configured to move the recording medium and the plate relatively in an intersecting direction that intersects a facing direction in which the recording medium and the plate face each other, while the recording medium is stopped in the image forming region.

According to the present aspect, the recording device includes a relative movement unit configured to move the recording medium and the plate relatively while the recording medium is stopped in the image forming region. Thus, while the recording medium is stopped in the image forming region, a position of a portion of the recording medium facing the opening can be changed in midstream. In other words, a position of the recording medium in which drying is efficient and a position of the recording medium in which drying is inefficient can be changed in midstream. Therefore, the recording medium can be efficiently dried without using excessive energy.

In the recording device according to a second aspect of the present disclosure, in the first aspect, the relative movement unit moves the plate with respect to the recording medium in a stopped state.

According to the present aspect, the plate is moved with respect to the recording medium in a stopped state. Thus, a risk of vibrating the recording medium in the image forming region can be reduced, and the recording medium and the plate can also be moved relatively.

In the recording device according to a third aspect of the present disclosure, in the first aspect, the relative movement unit includes, between the recording head and the drying unit in a transport direction of the recording medium, a transport path length changing unit configured to change a transport path length of the recording medium, and moves the recording medium with respect to the plate by changing the transport path length.

According to the present aspect, the transport path length changing unit configured to change a transport path length of the recording medium is provided between the recording head and the drying unit in the transport direction. Thus, the recording medium and the plate can be easily moved relatively by changing a transport path length while the recording medium is stopped in the image forming region.

The recording device according to a fourth aspect of the present disclosure in the third aspect further includes a roller located downstream from the drying unit in the transport direction, and configured to transport the recording medium in the transport direction, when the transport path length is changed to be shorter by the transport path length changing unit, by a distance corresponding to a difference between the transport path lengths before and after the change.

According to the present aspect, the roller located downstream from the drying unit in the transport direction, and configured to transport the recording medium in the transport direction by a difference before and after a change when the transport path length is changed to be shorter by the transport path length changing unit is provided. Thus, the recording medium can be moved by the difference by using a simple configuration such as the roller.

In the recording device according to a fifth aspect of the present disclosure, in any one of the first to fourth aspects, an amount of displacement by the relative movement unit is different from a distance being an integral multiple of a distance between each of the plurality of openings in the intersecting direction.

When the amount of displacement by the relative movement unit is the same as a distance being an integral multiple of the distance between each of the plurality of openings in the intersecting direction, a position of the recording medium in which drying is efficient and a position of the recording medium in which drying is inefficient may not be changed before and after a relative movement between the recording medium and the plate. However, according to the present aspect, the amount of displacement by the relative movement unit is different from the distance between each of the plurality of openings in the intersecting direction. Thus, a position of the recording medium in which drying is efficient and a position of the recording medium in which drying is inefficient being unchanged before and after a relative movement between the recording medium and the plate can be suppressed.

In the recording device according to a sixth aspect of the present disclosure, in the fifth aspect, an amount of displacement by the relative movement unit is shorter than a distance between each of the plurality of openings in the intersecting direction.

According to the present aspect, the amount of displacement by the relative movement unit is different from the distance between each of the plurality of openings in the intersecting direction. Thus, the amount of relative displacement of the recording medium and the plate can be reduced, and a load on the device due to the relative movement between the recording medium and the plate can be reduced.

In the recording device according to a seventh aspect of the present disclosure, in any one of the first to sixth aspects, the relative movement unit moves the recording medium and the plate relatively during image formation by the recording head.

According to the present aspect, the relative movement unit moves the recording medium and the plate relatively during image formation by the recording head. Thus, time during image formation by the recording head can be effectively utilized.

In the recording device according to an eighth aspect of the present disclosure, in any one of the first to seventh aspects, the relative movement unit moves the recording medium and the plate relatively in the same direction a plurality of times each time the transport unit stops.

According to the present aspect, the relative movement unit moves the recording medium and the plate in the same direction a plurality of times each time the transport unit stops. In other words, a position of the recording medium in which drying is efficient and a position of the recording medium in which drying is inefficient can be changed for a plurality of times in midstream. Thus, the recording medium can be dried more efficiently than a configuration in which the recording medium and the plate are moved relatively once each time the transport unit stops.

In the recording device according to an ninth aspect of the present disclosure, in any one of the first to seventh aspects, the relative movement unit moves the recording medium and the plate relatively in different directions a plurality of times each time the transport unit stops.

According to the present aspect, the relative movement unit moves the recording medium and the plate in different directions a plurality of times each time the transport unit stops. In other words, a position of the recording medium in which drying is efficient and a position of the recording medium in which drying is inefficient can be changed for a plurality of times in midstream. Thus, the recording medium can be dried more efficiently than a configuration in which the recording medium and the plate are moved relatively once each time the transport unit stops.

A method for drying a recording medium according to a tenth aspect of the present disclosure is a method for drying a recording medium in a recording device including a transport unit configured to alternately repeat transport and stop of a recording medium, a recording head configured to discharge ink onto the recording medium to form an image while the recording medium is stopped in an image forming region, and a drying unit including a plate in which a plurality of openings for blowing an air flow are formed in a position facing the recording medium transported by the transport unit, and being configured to dry the recording medium on which an image is formed by the recording head, and the method includes moving the recording medium and the plate relatively in an intersecting direction that intersects a facing direction in which the recording medium and the plate face each other, while the recording medium is stopped in the image forming region.

According to the present aspect, the recording medium and the plate are moved relatively in the intersecting direction while the recording medium is stopped in the image forming region. Thus, while the recording medium is stopped in the image forming region, a position of a portion of the recording medium facing the opening can be changed in midstream. In other words, a position of the recording medium in which drying is efficient and a position of the recording medium in which drying is inefficient can be changed in midstream. Therefore, the recording medium can be efficiently dried without using excessive energy.

An exemplary embodiment of the present disclosure will be described below with reference to the accompanying drawings.

Example 1

First, an overview of a recording device 1 according to Example 1 of the present disclosure will be described with reference to FIG. 1. Note that all of FIG. 1 and FIGS. 3, 4, and 6 described later is a schematic view, and some components are represented by simplification, omission, or the like.

The recording device 1 according to the present example is an inkjet recording device that discharges ink onto a recording medium M such as paper, cloth, a film, and the like, and that forms an image. The recording medium M having a different property of a material between an image forming surface and an image non-forming surface can be used, such as the recording medium M in which a resin such as polypropylene and vinyl chloride is used for the image forming surface, and release paper such as glassine paper is used for the image non-forming surface. Further, the recording device 1 according to the present example is communicatively coupled to a computer (not illustrated) being an external device. Note that, as illustrated in FIG. 1, the recording device 1 according to the present example is configured to be able to perform recording on the recording medium M wound in a roll form. Note that the image forming surface is a surface facing a recording head 4 in an image forming region S, and the image non-forming surface is a surface facing a platen 6 in the image forming region S.

As illustrated in FIG. 1, the recording device 1 according to the present example includes a set unit 2 that can feed the recording medium M by setting the recording medium M in the roll form and rotating in a rotation direction C. Further, the recording device 1 includes a plurality of rollers 3 as a transport unit that can transport the recording medium M fed from the set unit 2. The recording medium M is transported in a transport direction T by the plurality of rollers 3 inside the recording device 1.

The recording medium M transported by the roller 3 is recorded on the platen 6 by the recording head 4. The recording device 1 according to the present example discharges ink from the recording head 4 onto the image forming surface of the recording medium M supported by the platen 6, and forms an image. As illustrated in FIG. 1, the recording head 4 is formed on a carriage 5. Then, it is assumed that a position of the carriage 5 away from the image forming region S being a position facing the platen 6 is a standby position. Then, when a recording operation starts, the carriage 5 moves along a direction A being a direction along the transport direction T of the recording medium M, from the standby position to the image forming region S being the position facing the platen 6. Then, an operation of discharging ink from the recording head 4 while the carriage 5 moves in the direction A being a longitudinal direction of the recording medium M in the image forming region S, and an operation of moving in a direction B being a width direction of the recording medium M are repeated to form an image on the image forming surface of the recording medium M. Note that the recording medium M stops in the image forming region S while the ink is discharged from the recording head 4 to form an image. Thus, when the recording operation is performed, the recording medium M is intermittently transported by repeating a stop and a movement. In other words, the plurality of rollers 3 alternately repeat transport and stop of the recording medium M.

The recording medium M on which an image is formed by the recording head 4 in the image forming region S is transported to a drying unit 100 that dries the recording medium M. A detailed configuration of the drying unit 100 will be described later, but the drying unit 100 includes a chamber 101 as a drying furnace, and a plate 102 in which a plurality of openings 103 for blowing an air flow are formed in a position facing the recording medium M transported by the roller 3. Note that the plate 102 according to the present example is configured to be movable along the direction A and the direction B.

Then, the recording device 1 according to the present example includes a winding unit 7 that can wind the elongated recording medium M in the roll form on a downstream side of the drying unit 100 in the transport direction T. Note that the recording device 1 according to the present example rotates the set unit 2 and the winding unit 7 in the rotation direction C when the recording medium M is wound in the roll form with the image forming surface facing outward by using the recording medium M wound in the roll form with the image forming surface facing outward. However, the recording device 1 according to the present example can rotate the set unit 2 and the winding unit 7 in a direction opposite to the rotation direction C when the recording medium M is wound in the roll form with the image forming surface facing inward by using the recording medium M wound in the roll form with the image forming surface facing inward.

Figure 2:
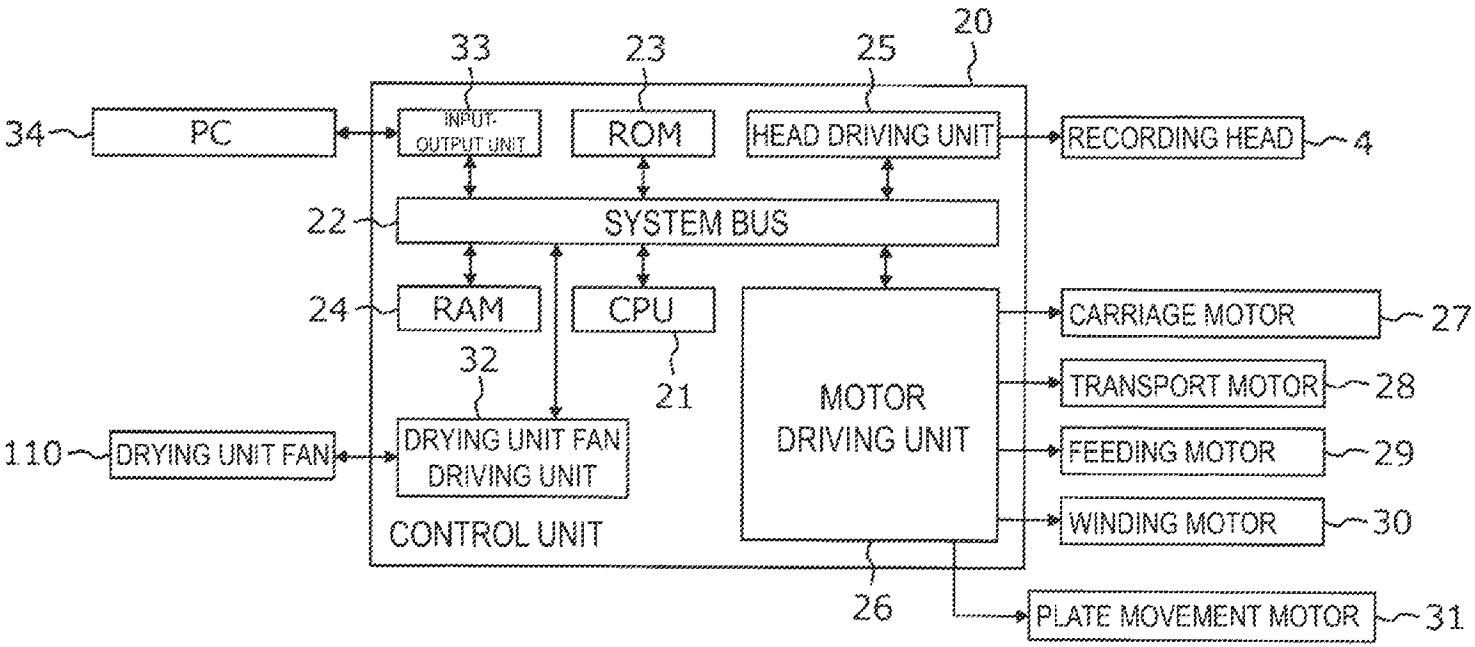
FIG. 2 is a block diagram illustrating an electrical configuration of the recording device according to Example 1 of the present disclosure.

Next, an electrical configuration of the recording device 1 according to the present example will be described with reference to FIG. 2. As illustrated in FIG. 2, the recording device 1 according to the present example includes a control unit 20. A CPU 21 that manages control of the entire recording device 1 is provided in the control unit 20. The CPU 21 is coupled through a system bus 22 to a ROM 23 that stores various control programs and the like implemented by the CPU 21, and a RAM 24 that can temporarily store data.

Further, the CPU 21 is coupled through the system bus 22 to a head driving unit 25 for driving the recording head 4, that is, for discharging ink.

Further, the CPU 21 is coupled through the system bus 22 to a motor driving unit 26 coupled to a carriage motor 27, a transport motor 28, a feeding motor 29, a winding motor 30, and a plate movement motor 31. Here, the carriage motor 27 is a motor for reciprocating, in the direction A, the carriage 5 on which the recording head 4 is mounted. Further, the transport motor 28 is a motor for driving the roller 3. Further, the feeding motor 29 is a rotating mechanism for the set unit 2, and is a motor that drives the set unit 2 in order to feed the recording medium M to the roller 3. Further, the winding motor 30 is a rotating mechanism for the winding unit 7, and is a motor that drives the winding unit 7 in order to wind the recording medium M in the roll form. Then, the plate movement motor 31 is a motor for moving the plate 102.

Further, the CPU 21 is coupled through the system bus 22 to a drying unit fan driving unit 32 that drives a plurality of various drying unit fans 110 described later in detail.

Further, the CPU 21 is coupled through the system bus 22 to an input-output unit 33 coupled to a PC 34 for receiving and transmitting data such as image data and a signal.

Next, a detailed configuration of the drying unit 100 of the recording device 1 according to the present example will be described with reference to FIGS. 3 and 4. As described above, the drying unit 100 includes the chamber 101. Then, as illustrated in FIG. 3, the plate 102 provided with the plurality of openings 103 (see FIG. 4) serving as a blowing outlet of an air flow, a pressure chamber 106 provided with the plate 102 on an upper surface, a stay 105 that contacts the image non-forming surface of the recording medium M and holds the recording medium M inside the chamber 101, and a rear plate 104 that fixes the stay 105 inside the chamber 100 are provided in the chamber 101.

Further, an exhaust fan 110A as the drying unit fan 110 is provided above the rear plate 104, and an exhaust chamber 107 that can store an air flow emitted from the inside of the chamber 101 is formed. An intake fan 110C as the drying unit fan 110 that can introduce gas from the outside of the device is provided in the exhaust chamber 107, and is also coupled to an exhaust path 109 for emitting gas inside the exhaust chamber 107 to the outside of the device, and a circulation path 108 for circulating, in the device, the gas inside the exhaust chamber 107. A blower fan 110B as the drying unit fan 110 that generates an air flow inside the circulation path 108 is provided in the circulation path 108, and a heater 111 for heating the air flow inside the circulation path 108 and causing gas blown onto the recording medium M to become heated gas is also provided. The gas heated by the heater 111 is introduced into the pressure chamber 106, and the heated gas introduced into the pressure chamber 106 is blown onto the recording medium M through the opening 103 of the plate 102. In other words, in the recording device 1 according to the present example, the gas blown onto the recording medium M through the opening 103 in the drying unit 100 is the heated gas.

Figure 3:
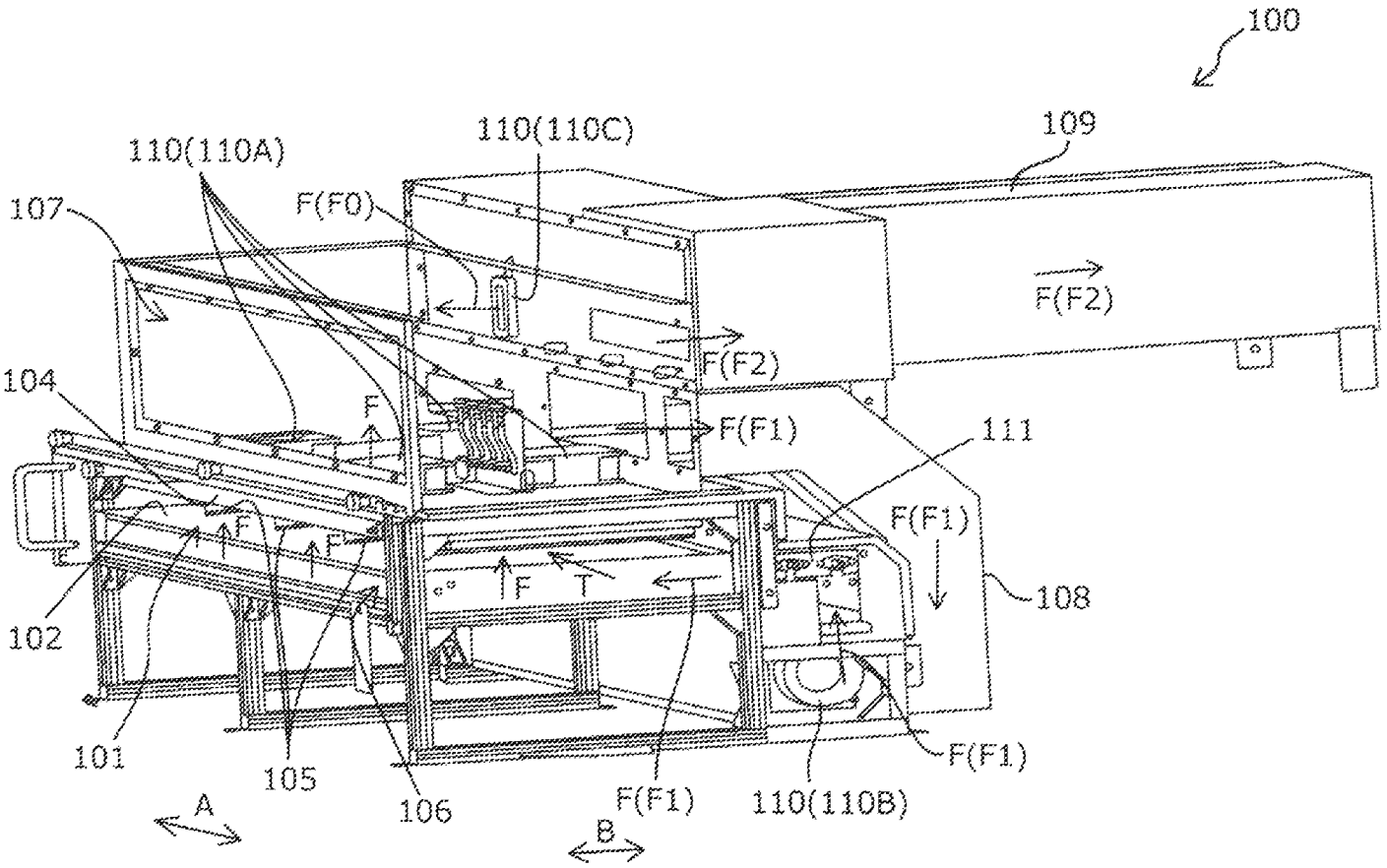
FIG. 3 is a schematic perspective view of a drying unit of the recording device according to Example 1 of the present disclosure.

Here, an arrow F in FIG. 3 represents a direction of an air flow in the drying unit 100. Of the arrows F, an arrow F0 represents a direction of an air flow introduced from the outside of the device to the exhaust chamber 107 by the intake fan 110C, an arrow F1 represents a direction of an air flow circulated from the exhaust chamber 107 to the circulation path 108, and an arrow F2 represents a direction of an air flow that flows from the exhaust chamber 107 to the exhaust path 109.

Figure 4:
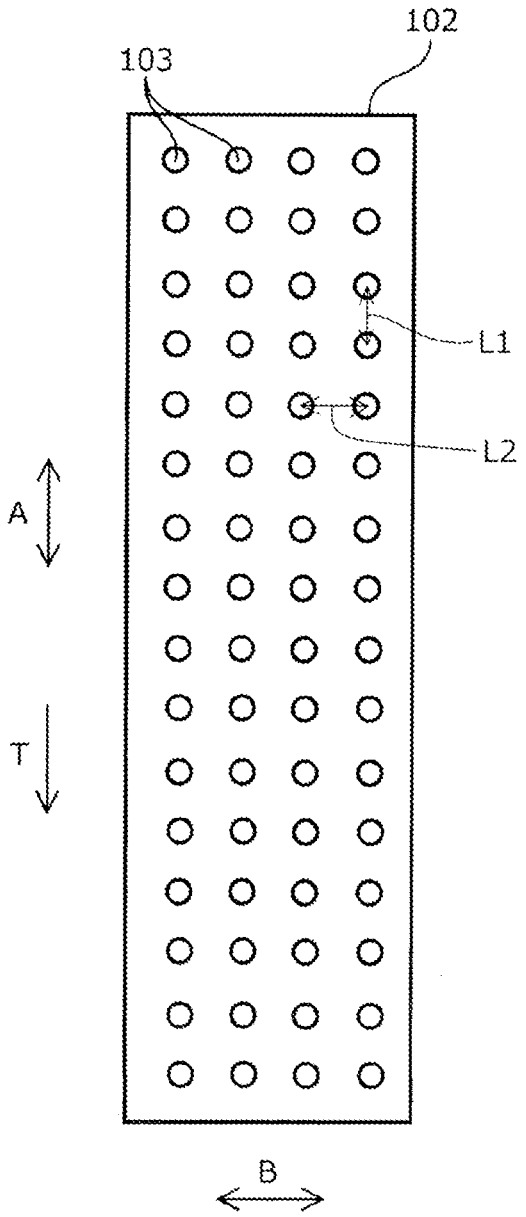
FIG. 4 is a schematic plan view of a plate of the recording device according to Example 1 of the present disclosure.

As illustrated in FIG. 4, the plurality of openings 103 serving as a blowing outlet of an air flow are provided in the plate 102. Note that, in FIG. 4, a few openings 103 are illustrated. The openings 103 are disposed side by side such that a distance between adjacent openings 103 in the direction A is a distance L1, and a distance between adjacent openings 103 in the direction B is a distance L2. As described above, the recording device 1 according to the present example is configured to be able to move the plate 102 by the plate movement motor 31 as a driving source. Specifically, the recording device 1 is configured to be able to move the plate 102 by a distance of half the distance L1 in the direction A and a distance of half the distance L2 in the direction B by the control of the control unit 20. Note that an arrangement and the number of the openings 103 formed in the plate 102 are not particularly limited.

An example in which the plate 102 moves during the recording operation in the recording device 1 according to the present Example will be described below with reference to a flowchart illustrated in FIG. 5. In other words, an example of a method for drying a recording medium in the recording device 1 according to the present example will be described.

In the recording device 1 according to the present example, when the recording operation starts, first, whether a transport of the recording medium M stops due to an intermittent transport of the recording medium M is determined in step S110. Note that the determination is performed by the control unit 20, and is repeatedly performed at a constant timing when the recording operation starts until it is determined that the transport of the recording medium M stops. In other words, step S110 is repeated until it is determined that the transport of the recording medium M stops. Then, in step S110, when it is determined that the transport of the recording medium M stops, the processing proceeds to step S120, and a measurement of stopping time starts.

Next, in step S130, whether a predetermined elapsed time elapses since the measurement of stopping time in step S120 starts is determined. Note that the determination is also performed by the control unit 20, and is repeatedly performed at a constant timing when the measurement of stopping time starts until it is determined that the predetermined time of the stopping time elapses. In other words, step S130 is repeated until it is determined that the predetermined time of the stopping time elapses. Then, in step S130, when it is determined that the predetermined time of the stopping time elapses, the processing proceeds to step S140, and the control unit 20 controls the plate movement motor 31 and moves the plate 102 by the distance of half the distance L1 in the direction A and the distance of half the distance L2 in the direction B.

Here, the predetermined time in step S130 in the present example specifically refers to half the time of one period of the stopping time of the recording medium M intermittently transported by the roller 3. For example, when one period of recording time in which the recording operation is performed by the recording head 4 while the recording medium M stops in the image forming region S, i.e., one period of the stopping time is 14 seconds, predetermined time here is seven seconds. Thus, a position of the image forming surface of the recording medium M facing the opening 103 formed in the plate 102 is shifted in a first half and a second half of one period of the stopping time in the intermittent transport.

Then, in step S150, the control unit 20 determines whether the recording has ended. Here, when the control unit 20 determines that the recording has ended, the method for drying a recording medium in the recording device 1 according to the present example ends. On the other hand, when the control unit 20 determines that the recording has not ended, the processing returns to step S110, and step S110 to step S150 are repeated until the control unit 20 determines that the recording has ended in step S150.

As described above, in the method for drying a recording medium in the recording device 1 according to the present example, the control unit 20 as a relative movement unit configured to move the recording medium M and the plate 102 relatively moves the recording medium M and the plate 102 relatively in the direction A and the direction B being an intersecting direction that intersects a facing direction in which the recording medium M and the plate 102 face each other, while the recording medium M is stopped in the image forming region, Thus, while the recording medium M is stopped in the image forming region S, the recording device 1 according to the present example can change a position of the portion of the recording medium M facing the opening 103 in midstream by performing the method for drying a recording medium described above. In other words, the recording device 1 according to the present example can change a position of the recording medium M in which drying is efficient and a position of the recording medium M in which drying is inefficient in midstream. Therefore, the recording device 1 according to the present example can efficiently dry the recording medium M without using excessive energy. Note that the recording device 1 according to the present example moves the plate 102 in both of the direction A and the direction B while the recording medium M is stopped in the image forming region S, but the recording device 1 is not limited to such a configuration, and may be configured to move the plate 102 only in one direction of the intersecting directions, such as the direction A or the direction B.

Here, in the recording device 1 according to the present example, the control unit 20 moves the plate 12 with respect to the recording medium M in a stopped state. Thus, a risk of vibrating the recording medium M in the image forming region S can be reduced, and the recording medium M and the plate 102 can also be moved relatively. However, the recording device 1 is not limited to such a configuration, and may be configured to move the recording medium M with respect to the plate 12 in a stopped state, or configured to move the recording medium M and the plate 102 together.

Note that, as described above, the amount of displacement of the plate 12 with respect to the recording medium M in step S140 is half the distance between the openings 103 in both of the direction A and the direction B. In other words, the amount of displacement of the plate 12 with respect to the recording medium M is different from a distance being an integral multiple of a distance between each of the plurality of openings 103 in the direction A and the direction B as the intersecting direction. When the amount of displacement of the plate 12 with respect to the recording medium M is the same as the distance between each of the plurality of openings 103 in the intersecting direction, a position of the recording medium M in which drying is efficient and a position of the recording medium M in which drying is inefficient may not be changed before and after a relative movement between the recording medium M and the plate 102. However, in the recording device 1 according to the present example, the amount of displacement of the plate 12 with respect to the recording medium M is different from the distance being an integral multiple of the distance between each of the plurality of openings 103 in the intersecting direction. Thus, the recording device 1 according to the present example can suppress the position of the recording medium M in which drying is efficient and the position of the recording medium M in which drying is inefficient being unchanged before and after a relative movement between the recording medium M and the plate 102. Here, as indicated by the distance L1 and the distance L2 in FIG. 4, the "distance between each of the plurality of openings 103" refers to a distance between central portions of adjacent openings 103 in a direction substantially along the direction A and the direction B being a relative movement direction of the recording medium M and the plate 102.

Further, to express the description above in other words, the amount of displacement of the plate 12 with respect to the recording medium M is shorter than the distance between each of the plurality of openings 103 in the intersecting direction. Thus, the recording device 1 according to the present example can reduce the amount of relative displacement of the recording medium M and the plate 102, and can reduce a load on the device due to the relative movement between the recording medium M and the plate 102. Note that, in the present example, as described above, the amount of displacement of the plate 12 with respect to the recording medium M in step S140 is half the distance between the openings 103 in both of the direction A and the direction B, and a position of the recording medium M in which drying is efficient and a position of the recording medium M in which drying is inefficient can be changed most efficiently. However, the amount of displacement is not limited to such an amount of displacement.

Further, in the recording device 1 according to the present example, the control unit 20 moves the recording medium M and the plate 102 relatively during image formation by the recording head 4. Thus, time during image formation by the recording head 4 can be effectively utilized.

Figure 5:
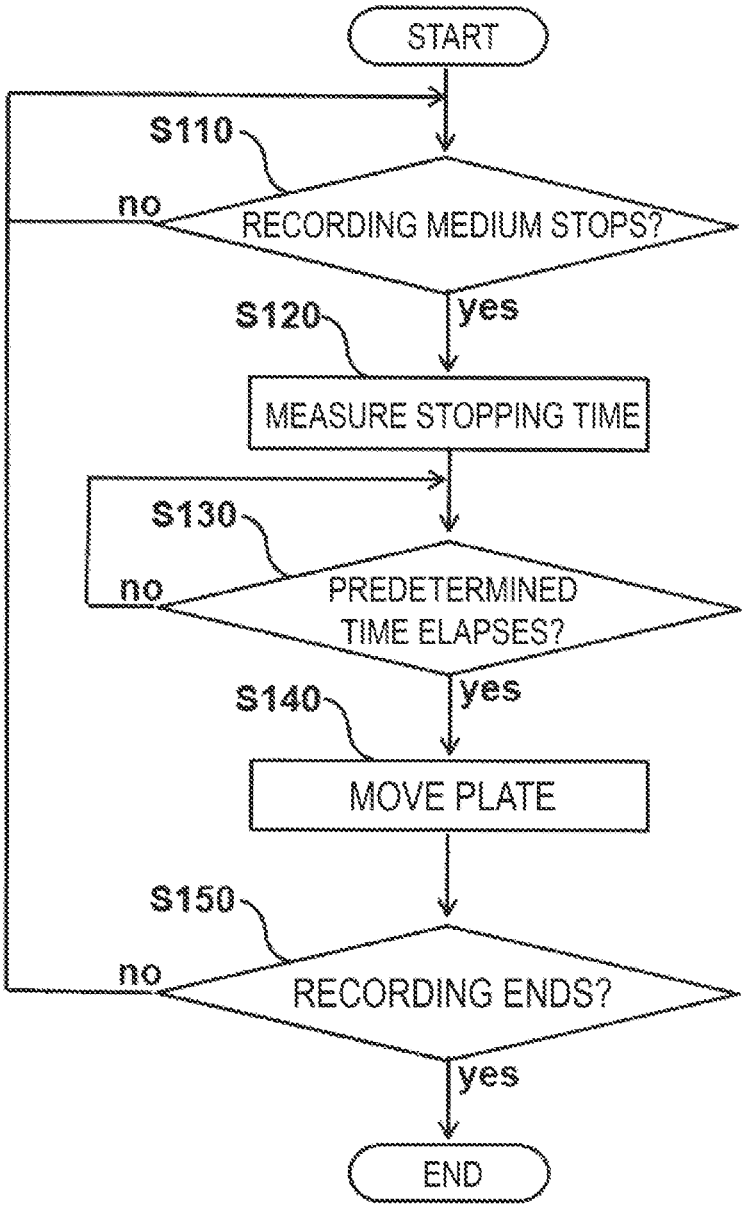
FIG. 5 is a flowchart of a three-dimensional manufacturing method performed using the recording device according to Example 1 of the present disclosure.

Note that, in the recording device 1 according to the present example, as illustrated in the flowchart in FIG. 5, the control unit 20 can move the recording medium M and the plate 102 relatively once in the same direction for each single stop in an intermittent transport by the roller 3. On the other hand, in the recording device 1 according to the present example, the control unit 20 can move the recording medium M and the plate 102 relatively in the same direction for a plurality of times for each single stop in an intermittent transport by the roller 3. For example, the recording medium M and the plate 102 can be moved relatively in the same direction by one quarter of the distance between each of the plurality of openings 103 in the intersecting direction for three times per predetermined time. Furthermore, in the recording device 1 according to the present example, the control unit 20 can move the recording medium M and the plate 102 in different directions for a plurality of times for each single stop in an intermittent transport by the roller 3. For example, the recording medium M and the plate 102 can be moved in a predetermined direction by the distance of half the distance between each of the plurality of openings 103 in the intersecting direction after predetermined time, and then can be further returned to an original position after the predetermined time. In other words, the recording device 1 according to the present example can change a position of the recording medium M in which drying is efficient and a position of the recording medium M in which drying is inefficient for a plurality of times in midstream. Thus, the recording device 1 according to the present example can dry the recording medium M more efficiently than a configuration in which the recording medium M and the plate 102 can only be moved relatively once for each single stop in an intermittent transport by the roller 3.

Example 2

Figure 6:
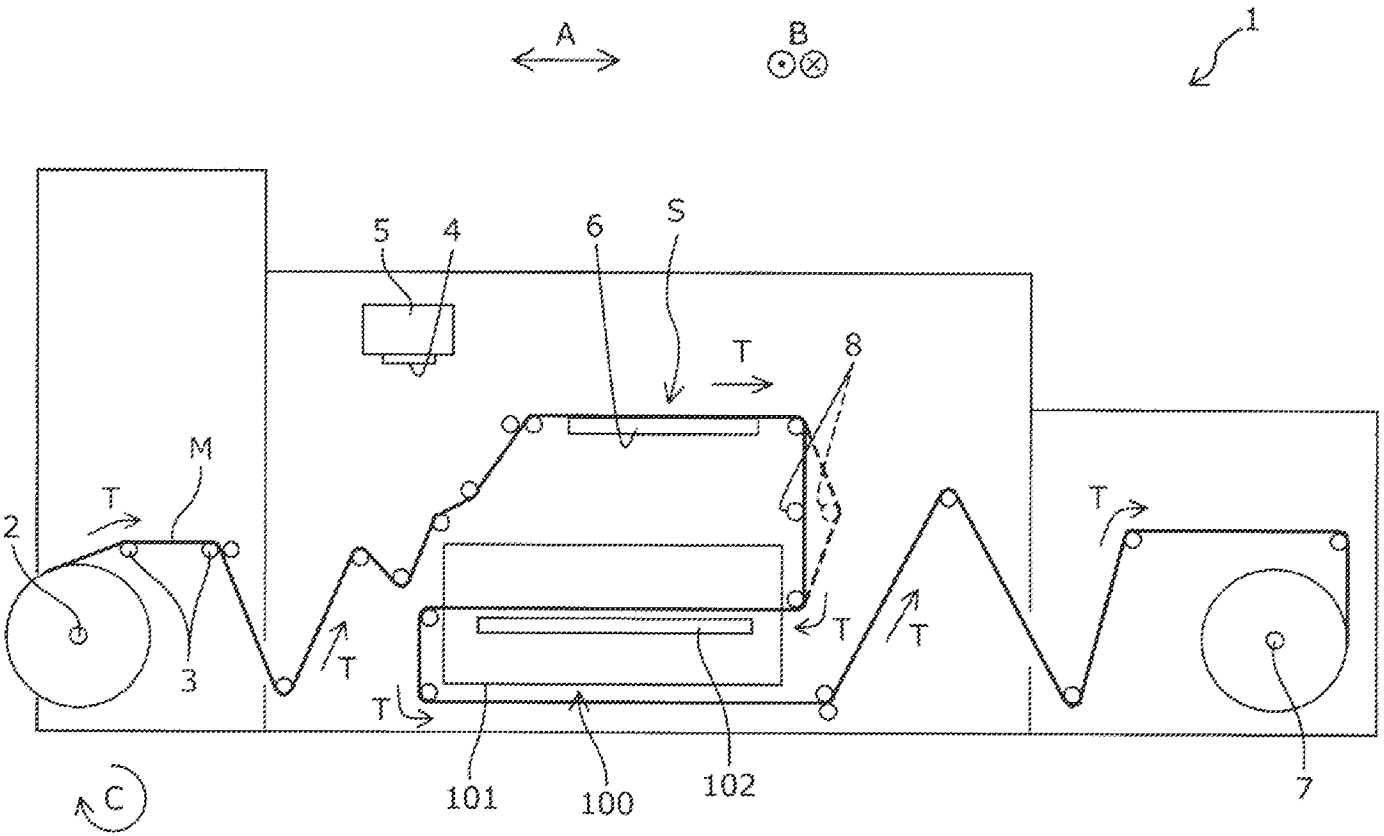
FIG. 6 is a schematic side view of a recording device according to Example 2 of the present disclosure.

Next, a recording device 1 according to Example 2 of the present disclosure will be described with reference to FIG. 6. FIG. 6 is a diagram that corresponds to FIG. 1 in the recording device 1 according to Example 1. Here, the recording device 1 according to the present example has a configuration similar to that of the recording device 1 according to Example 1 except for a configuration in which a recording medium M and a plate 102 are moved relatively, and has a characteristic similar to that of the recording device 1 according to Example 1 except for a characteristic described below. Thus, description of a portion having a common configuration will be omitted, and a component common to a component in Example 1 described above is denoted by the same reference numeral and detailed description will be omitted.

As described above, the recording device 1 according to Example 1 has a configuration in which the control unit 20 can control the plate movement motor 31, and can move the plate 102 with respect to the recording medium M in a stopped state. On the other hand, as illustrated in FIG. 6, the recording device 1 according to the present example includes, as a relative movement unit, a transport path length changing unit 8 that changes a transport path length of the recording medium M between a recording head 4 and a drying unit 100 in a transport direction T of the recording medium M, and can move the recording medium M with respect to the plate 102 by changing the transport path length of the recording medium M. Specifically, the transport path length changing unit 8 is a roller that can move along a direction A, and changes a transport path length of the recording medium M by moving between a position indicated by a solid line in FIG. 6 and a position indicated by a dashed line during image formation by the recording head 4 and during stopping in an intermittent transport by a roller 3.

In this way, the recording device 1 according to the present example includes the transport path length changing unit that changes a transport path length of the recording medium M between the recording head 4 and the drying unit 100 in the transport direction T. Thus, the recording device 1 according to the present example can easily move the recording medium M and the plate 102 relatively by changing a transport path length while the recording medium M is stopped in an image forming region S without adopting a configuration that moves a heavy plate 102.

Then, the recording device 1 according to the present example also includes the roller 3 downstream from the drying unit 100 in the transport direction T. In other words, the recording device 1 according to the present example includes, downstream from the drying unit 100 in the transport direction T, the roller 3 that transports the recording medium M in the transport direction T by a difference before and after a change when a transport path length is changed to be shorter by the transport path length changing unit 8. Thus, the recording device 1 according to the present example can move the recording medium M by the difference by using a simple configuration such as the roller 3. However, the recording device 1 may transport the recording medium M in the transport direction T by a difference before and after a change when a transport path length is changed to be shorter by the transport path length changing unit 8 by using a component different from the roller 3.

Note that the present disclosure is not limited to the aforementioned example, and many variations are possible within the scope of the disclosure as described in the appended claims. It goes without saying that such variations also fall within the scope of the present disclosure.

What is claimed is:

1. A recording device, comprising:

a transport unit configured to alternately repeat transport and stop of a recording medium;

a recording head configured to discharge ink onto the recording medium to form an image while the recording medium is stopped in an image forming region;

a drying unit including a plate in which a plurality of openings for blowing an air flow are formed in a position facing the recording medium transported by the transport unit, and being configured to dry the recording medium on which an image is formed by the recording head; and a relative movement unit configured to move the recording medium and the plate relatively in an intersecting direction that intersects a facing direction in which the recording medium and the plate face each other, while the recording medium is stopped in the image forming region, wherein an amount of displacement by the relative movement unit is different from a distance being an integral multiple of a distance between each of the plurality of openings in the intersecting direction.

2. The recording device according to claim 1, wherein the relative movement unit moves the plate with respect to the recording medium in a stopped state.

3. The recording device according to claim 1, wherein the relative movement unit includes, between the recording head and the drying unit in a transport direction of the recording medium, a transport path length changing unit configured to change a transport path length of the recording medium, and moves the recording medium with respect to the plate by changing the transport path length.

4. The recording device according to claim 3, comprising a roller located downstream from the drying unit in the transport direction, and configured to transport the recording medium in the transport direction, when the transport path length is changed to be shorter by the transport path length changing unit, by a distance corresponding to a difference between the transport path lengths before and after the change.

5. The recording device according to claim 1, wherein an amount of displacement by the relative movement unit is smaller than a distance between each of the plurality of openings in the intersecting direction.

6. The recording device according to claim 1, wherein the relative movement unit moves the recording medium and the plate relatively during image formation by the recording head.

7. The recording device according to claim 1, wherein the relative movement unit moves the recording medium and the plate relatively in the same direction a plurality of times each time the transport unit stops.

8. The recording device according to claim 1, wherein the relative movement unit moves the recording medium and the plate relatively in different directions a plurality of times each time the transport unit stops.

9. A method for drying a recording medium in a recording device including a transport unit configured to alternately repeat transport and stop of a recording medium, a recording head configured to discharge ink onto the recording medium to form an image while the recording medium is stopped in an image forming region, and a drying unit including a plate in which a plurality of openings for blowing an air flow are formed in a position facing the recording medium transported by the transport unit, and being configured to dry the recording medium on which an image is formed by the recording head, the method comprising:

moving the recording medium and the plate relatively in an intersecting direction that intersects a facing direction in which the recording medium and the plate face each other, while the recording medium is stopped in the image forming region, wherein an amount of displacement by the relative movement unit is different from a distance being an integral multiple of a distance between each of the plurality of openings in the intersecting direction.

* * * * *